US009372496B2

(12) United States Patent
Arnold

(10) Patent No.: US 9,372,496 B2
(45) **Date of Patent: *Jun. 21, 2016**

(54) ELECTRONIC DEVICE AND METHOD FOR GENERATING A CURVATURE COMPENSATED BANDGAP REFERENCE VOLTAGE

(71) Applicant: Texas Instruments Incorporated, Dallas, TX (US)

(72) Inventor: Matthias Arnold, Freising (DE)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/811,896

(22) Filed: Jul. 29, 2015

(65) Prior Publication Data

US 2015/0331439 A1 Nov. 19, 2015

Related U.S. Application Data

(62) Division of application No. 13/025,896, filed on Feb. 11, 2011, now Pat. No. 9,104,217.

(30) Foreign Application Priority Data

Feb. 12, 2010 (DE) ..... 10 2010 007 771

(51) Int. Cl.
*G05F 3/16* (2006.01)
*G05F 3/26* (2006.01)
*G05F 3/30* (2006.01)

(52) U.S. Cl.
CPC *G05F 3/267* (2013.01); *G05F 3/16* (2013.01); *G05F 3/30* (2013.01)

(58) Field of Classification Search
CPC ..... G05F 3/16; G05F 3/30; G05F 3/247; G05F 3/262; G05F 3/265
USPC ..... 323/313–316, 909
See application file for complete search history.

(56) References Cited

U.S. PATENT DOCUMENTS

| | | | | |
|---|---|---|---|---|
| 4,902,959 | A * | 2/1990 | Brokaw | G05F 3/30 323/314 |
| 4,939,442 | A * | 7/1990 | Carvajal | G05F 3/30 323/281 |
| 6,255,807 | B1 * | 7/2001 | Doorenbos | G05F 3/30 323/314 |
| 6,340,882 | B1 * | 1/2002 | Chung | G05F 3/225 323/314 |
| 6,750,641 | B1 * | 6/2004 | Ivanov | G05F 3/30 323/315 |
| 7,626,374 | B2 * | 12/2009 | Haiplik | G05F 3/30 323/313 |

(Continued)

*Primary Examiner* — Adolf Berhane
(74) *Attorney, Agent, or Firm* — Robert D. Marshall, Jr.; Frank D. Cimino

(57) ABSTRACT

The invention relates to an electronic device with a bandgap reference generator including a first path with series connection of a first bipolar transistor, a first resistor and a second resistor, and a second path with series connection of a second bipolar transistor and a third resistor. The first and second paths are supplied current via a common node through a fourth resistor controlled by an amplifier sensing voltage drops within the first and second paths. A curvature compensation stage compensates for a variation of base emitter voltage of the bipolar transistors by drawing a compensation current from the common resistor node.

5 Claims, 2 Drawing Sheets

(56) References Cited

U.S. PATENT DOCUMENTS 9,104,217 B2 * 8/2015 Arnold ..... G05F 3/30
2001/0040254 A1 * 11/2001 Takiguchi ..... H01L 21/8222 257/341
2003/0080720 A1 * 5/2003 Ghozeil ..... G05F 3/30 323/313
2005/0194957 A1 * 9/2005 Brokaw ..... G05F 3/30 323/316
2005/0237045 A1 * 10/2005 Lee ..... G05F 3/30 323/313
2008/0157740 A1 * 7/2008 Gurcan ..... G05F 1/565 323/283
2010/0164466 A1 * 7/2010 Jo ..... G05F 3/30 323/313

* cited by examiner

ELECTRONIC DEVICE AND METHOD FOR GENERATING A CURVATURE COMPENSATED BANDGAP REFERENCE VOLTAGE

CLAIM OF PRIORITY

This application is a divisional of U.S. patent application Ser. No. 13/025,896 filed Feb. 11, 2011 and claims priority under 35 U.S.C. 119(s) to German Patent Application No. 10 2010 007 771.2 filed Feb. 12, 2010.

TECHNICAL FIELD OF THE INVENTION

The technical field of this invention is an electronic device and method for generating a curvature compensated bandgap reference voltage.

BACKGROUND OF THE INVENTION

Accurate analog-to-digital converters are needed which for various applications needing very exact reference voltages having low temperature drift. The design and manufacture of low cost and highly accurate references in digital CMOS processes is difficult. Providing test flow on automatic test equipment (ATE) is another important aspect of manufacturing these electronic devices. Production trimming is expensive and should avoided whenever possible. A typical test procedure includes only two test insertions at two temperatures. The lower temperature is generally not the minimum operating temperature of the device. Thus a trimming procedure does not necessarily provide the most accurate devices. Thus there is a need for electronic devices and methods which provide highest accuracy without trimming and which are easy to implement.

The most accurate approach to achieve stable reference voltages employs the bandgap of bipolar transistors in bandgap reference voltage generators. These reference generators employ the base-emitter voltage (VBE) of bipolar transistors. The base-emitter voltage of a bipolar transistor is not absolutely stable over temperature. Thus measures to stabilize VBE over temperature are required. "Accurate Analysis of Temperature Effects in IC-VBE Characteristics with Application to Bandgap Reference Sources", IEEE ISSC 1980 by Y. Tsividis provides a very detailed analysis of temperature effects on VBE. "Precision Temperature Sensors in CMOS Technology," Springer, 2006 by M. Pertis and J. Huijsing provides a briefer and more comprehensible analysis.

The variation of VBE is referred to as curvature of VBE. This generally results from non-linear temperature behavior of the BJT saturation current. A non-linear bias current which exactly cancels out the non-linearity of VBE might be used to compensate or linearize VBE.

The VBE curvature may be compensated according to different principles. These include: VBE linearization with non-linear bias currents or voltages using a temperature dependent gain for a AVBE which is added to VBE; and adding piecewise linear voltages to AVBE and VBE to compensate the VBE curvature.

FIG. 1 illustrates a simplified schematic of prior art circuit with VBE curvature compensation. A first bipolar transistor Q1 and a second bipolar transistor Q2 with emitter areas having a ratio of 1:N are in two different current paths. Both the bases and collectors of Q1 and Q2 are coupled to ground. This restriction is imposed by some CMOS technologies where bipolar transistors may only be provided with bases and collectors coupled to ground. First resistor R1 and second resistor R2 are coupled in series with the channel of Q1. Resistor R2*a* is coupled to the channel of Q2. The node between R2*a* and the emitter of Q2 is VIP. The node between R1 and R2 is VIM. Node VIP is coupled to the positive input of transconductance amplifier OTA. Node VIM is coupled to the inverted or negative input of transconductance amplifier OTA. The output of OTA is coupled to the gate of NMOS transistor N1. N1 is coupled with its channel between power supply VDD and an NWELL resistor R4. NWELL resistor R4 is coupled in series with resistor R3. Resistor R3 is coupled to a common resistor node with resistors R2*a* and R2. NWELL resistor R4 implements VBE curvature compensation. NWELL resistor R4 has a high temperature coefficient. The change of the voltage drop across R4 is combined with VBE across Q2 and Q2 and the positive temperature coefficients of R3, R2, R2*a* and R1. The non-linear voltage drop across R4 compensates the non-linearity of VBE. This prior art VBE curvature compensation is easy to design and can be added to existing designs without much modifications. It does not require a lot additional chip area. This prior art contributes an additional process sensitivity to the bandgap reference generator due to the NWELL sheet resistance. This NWELL sheet resistance it fairly difficult to control in known CMOS or BICMOS technologies and renders VBE curvature compensation less robust than required.

SUMMARY OF THE INVENTION

It is an object of the invention to provide an electronic device or a method generating a bandgap reference voltage which is more accurate, less sensitive to process variations and production spread without being more expensive or complex than the prior art.

In one aspect of the invention, an electronic device includes a bandgap reference generator. The bandgap reference generator includes a first path with a first bipolar transistor. The collector-emitter channel of this first bipolar transistor is be coupled in series with a first resistor and a second resistor. The first resistor is coupled in series with the second resistor at one terminal and the other terminal is connected to a collector or emitter of the first bipolar transistor. The bandgap reference generator includes a second path with a second bipolar transistor coupled with its collector-emitter channel in series with a third resistor. One terminal of the third resistor is coupled to a collector or an emitter of the second bipolar transistor. The term channel refers to the current path between collector and emitter of the bipolar transistor.

In an embodiment, coupling the channel in series with a resistor includes coupling either the collector or emitter of the bipolar transistor to the resistor in order to provide a current path through the resistor and the channel (from collector to emitter or vice versa) of the bipolar transistor. The first bipolar transistor has an emitter area which is N times the emitter area of the second bipolar transistor. The first path and the second path of the bandgap reference generator are coupled to a common resistor node to which one terminal of the second and third resistors and one terminal of the fourth resistor are coupled. The fourth resistor is coupled to a variable current source such as a transistor controlled by a feedback loop which supplies a current to the common resistor node through the fourth resistor. The bandgap reference generator also includes a curvature compensation stage generating a compensation current compensating for temperature dependent variation of the voltage drop across the first and/or the second bipolar transistor. This may be a variation of the base-emitter voltage of a bipolar transistor. The curvature compensation current is advantageously drawn from the common resistor node. The electronic device does not need an NWELL resistor thereby avoiding the sensitivity to design parameters of NWELL resistors.

The circuit includes a control loop with an amplifier. The amplifier is coupled with a first input to the first path and a second input to the second path. The amplifier controls the current through the first and/or second path in a feedback configuration or control loop. In an embodiment, the non-inverting input of the amplifier (which may be an operational amplifier or an operational transconductance amplifier) is coupled to the node where the collector or the emitter of the second bipolar transistor and the third resistor are coupled together. The inverting input of the amplifier is coupled to the node between the first and the second resistors. The output of the amplifier controls the current through the fourth resistor to the common resistor node. The output of the amplifier is coupled to the control gate of transistor N1. Transistor N1 has one terminal (e.g. drain or source) coupled to a supply voltage node and the other side terminal connected to the fourth resistor.

The curvature compensation stage generating a non-linear compensation current for compensating a temperature dependent variation of a voltage drop across the bipolar transistors shares a biasing stage with the amplifier. The curvature compensation stage may be implemented as an add-on to the amplifier instead of being implemented separately.

The curvature compensation stage is preferably a translinear current mode circuit. A translinear current mode circuit is inherently stable and accurate and can be easily implemented as an add-on to the amplifier. Translinear current mode circuits are suitable to implement higher order functions of voltages or currents. The translinear current mode circuit may include a mismatched current mirror. In a preferred embodiment, the translinear current mode circuit supplies a non-linear compensation current through the first or second bipolar transistor (such as the collector current) which varies with temperature according to the third power of the temperature.

Mismatch may be achieved using resistors in the curvature compensation stage. The resistors may advantageously be of the same type as the other resistors in the bandgap reference generator. This avoids using resistors of a different type, such as the NWELL transistor in prior art solutions. The curvature compensation stage can use the same devices as the remainder of the bandgap reference generator (for example MOS transistors and poly-silicon resistors, except for the first bipolar transistor and the second bipolar transistor). The curvature compensation current then depends on gate oxide thickness only. This is usually well controlled in CMOS technologies. Process variations of the resistance values of the resistors affect the bandgap core, the curvature compensation stage and the amplifier. The negative effects cancel each other out and reduce the effects of process variation.

The curvature compensation current is advantageously generated by the VBE curvature compensation stage which includes a translinear current mode circuit according to the above aspects of the invention.

The VBE curvature compensation stage and in particular the translinear current mode circuit or the mismatched current mirror are implemented to transform the amplifier bias current into a non-linear compensation current which is fed or drawn from the common resistor node from the bandgap reference generator.

In an embodiment, the curvature compensation stage includes at least one current mirror having a resistor in only one current path. The modified current mirror provides the voltage drop across the resistor in one current path which contributes to the gate source voltage of a transistor in the other current path. The current through a first path of the current mirror controls the gate source voltage of a transistor in a second path of the current mirror so that the current in the second path is squared. An advantageous embodiment includes two current mirrors both of which have a resistor in one path as previously described. A combination of the two current mirrors provides a transfer function for an input current which can be a function of the input current to the fourth power.

The invention is also a method of generating a bandgap reference voltage. A current through a first path and a second path each including a bipolar transistor is controlled via a feedback loop using an amplifier. A curvature compensation stage generates a compensation current compensating for a temperature dependent variation of a voltage drop across the bipolar transistors. The curvature compensation stage shares a common biasing stage with the amplifier. A bias current from the biasing stage may be transformed by the curvature compensation stage into a non-linear compensation current. The non-linear compensation current is fed to or drawn from a node of the bandgap reference generator to generate a voltage drop across a resistor having a positive temperature coefficient.

BRIEF DESCRIPTION OF THE DRAWINGS

These and other aspects of this invention are illustrated in the drawings, in which.

DETAILED DESCRIPTION OF PREFERRED EMBODIMENTS

Figure 1:
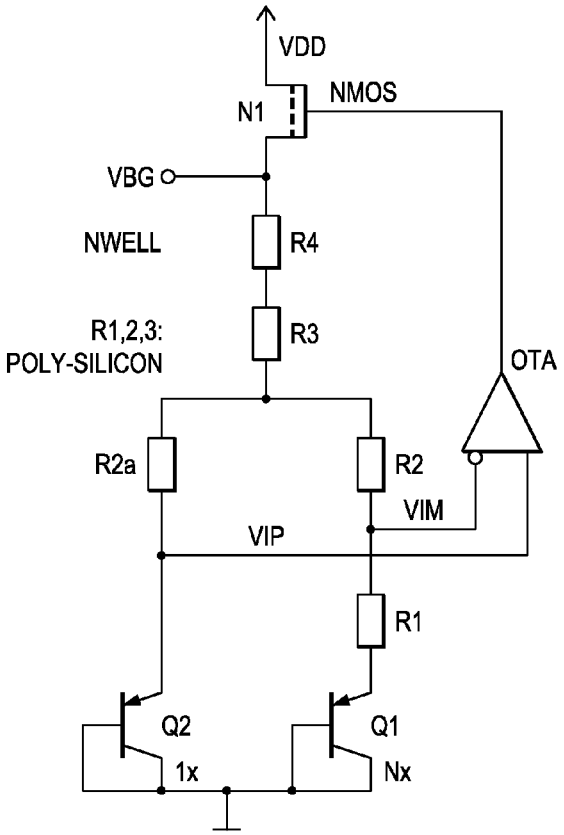
FIG. 1 (PRIOR ART)
FIG. 1 is a simplified circuit diagram of a bandgap reference generator with VBE curvature compensation according to the prior art.
Figure 2:
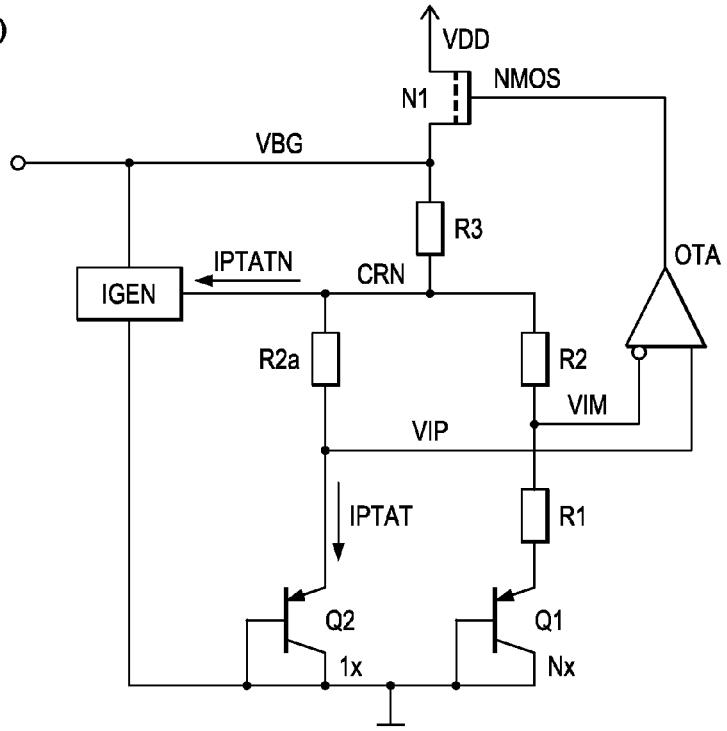
FIG. 2 is a simplified circuit diagram of a bandgap reference generator with VBE curvature compensation according to an embodiment of the invention.

FIG. 2 illustrates a simplified circuit diagram of a bandgap reference generator with a VBE curvature compensation according to an embodiment of the invention.

There are two current paths. The first path includes a first bipolar transistor Q1 and two series resistors R1 and R2. Resistors R1 and R2 may be poly-silicon resistors. Both the base and the collector of Q1 are coupled to ground. The second current path includes a second bipolar transistor Q2. The second transistor Q2 also has both its base and collector coupled to ground. This connection of transistors Q1 and Q2 are due to restrictions of the technology used for implementing the electronic device. A typical CMOS technology forms the electronic device as an integrated semiconductor electronic device. The emitter area of Q1 is N times the emitter area of Q2. Resistor R1 has one terminal coupled to the emitter of Q1 and other terminal coupled to R2. The node between R1 and R2 is VIM. Resistor R2*a* has one terminal coupled to the emitter of transistor Q2 and with the terminal coupled to the common resistor node CRN. The node between Q2 and R2*a* is VIP. Nodes VIM and VIP of the first and the second paths are coupled to respective negative and the positive input of amplifier OTA. Amplifier OTA is a transconductance amplifier. The output of amplifier OTA is coupled to the control gate of transistor N1. In this embodiment transistor N1 is an NMOS transistor. Amplifier OTA and transistor N1 form feedback loop controlling and stabilizing the bandgap voltage on node VBG. The channel of transistor N1 is coupled between power supply VDD and one terminal of resistor R3. The other terminal of resistor R3 is coupled to the common resistor node CRN. The reference voltage is provided at node VBG between R3 and transistor N1. According to an aspect of the invention curvature compensation stage IGEN draws a current IPTATN from the common resistor node CRN. The current IPTATN serves as the VBE curvature compensation current. The current IPTATN is generated by curvature compensation stage IGEN as explained in detail with respect to FIG. 3 and implemented as an add-on to the amplifier OTA. Current IPTATN is non-linear and generates a voltage drop across R3 which compensates the temperature dependent variation of VBE.

Figure 3:
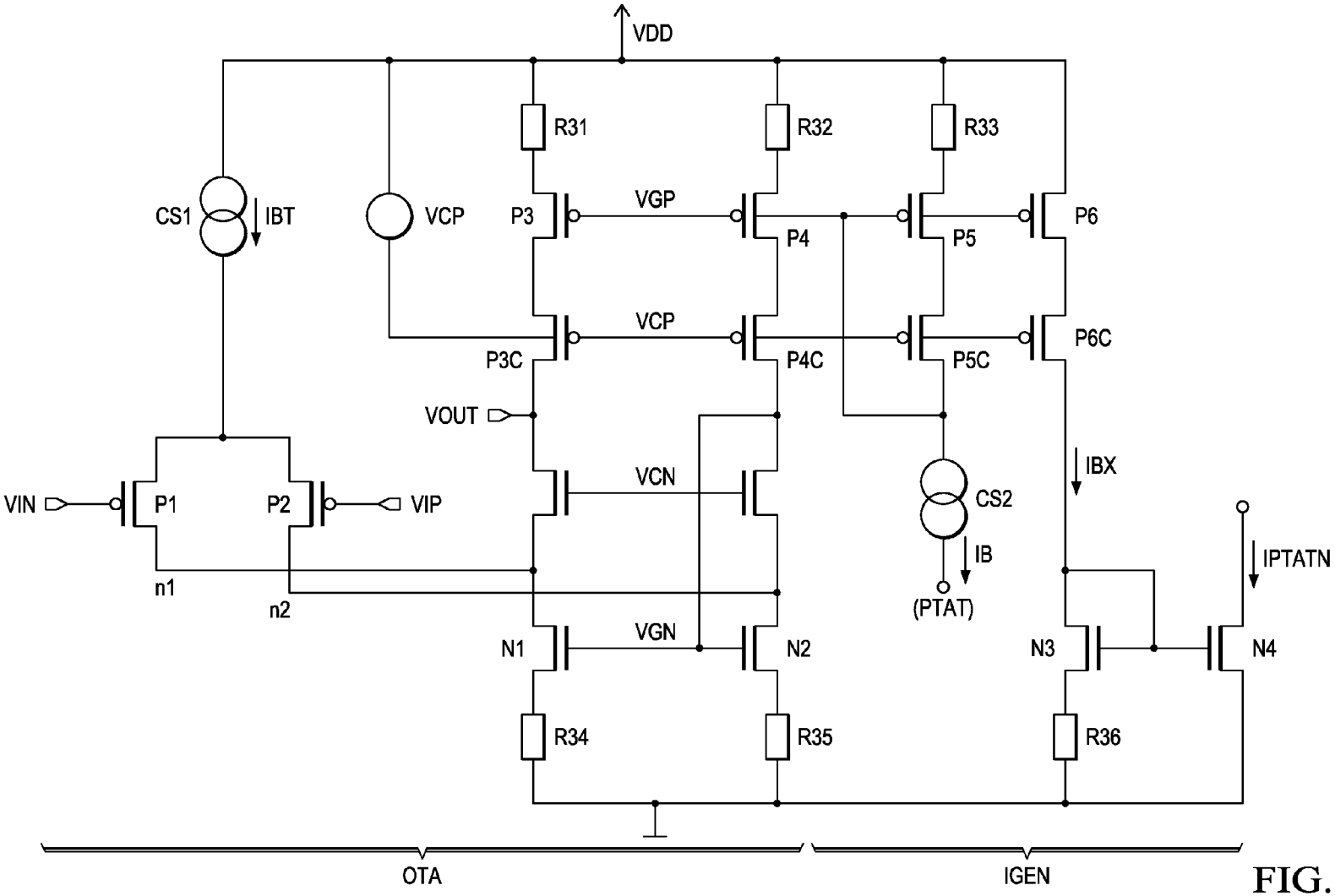
FIG. 3 is a simplified circuit diagram illustrating details of the embodiment shown in FIG. 2.

FIG. 3 shows a simplified circuit diagram of parts of the embodiment of FIG. 2 in more detail. FIG. 3 shows amplifier OTA and curvature compensation stage IGEN. According to an aspect of the invention, curvature compensation stage IGEN is implemented as an add-on to the amplifier OTA. FIG. 3 illustrates amplifier OTA as a transconductance amplifier. Amplifier OTA includes a differential pair of PMOS transistors P1 and P2 as the input stage. The control gates of transistors P1 and P2 are coupled to nodes VIM and VIP as indicated in FIG. 2. Current source CS1 supplies a tail current IBT to the differential pair of transistors P1 and P2. Amplifier OTA has a folded cascade OTA configuration which is known in the art. Input stage transistors P1 and P2 are coupled to an output stage including transistors P3, P4, P3C, P4C, N1 and N2, and resistors R31, R32, R34 and R35. The resistors R31, R32, R34 and R35 may advantageously be poly-silicon resistors and of the same type as all other resistors (R33, R36) used in curvature compensation stage IGEN. The voltage levels on nodes VCP and VCN may be derived from the bandgap voltage reference or in another way. Curvature compensation stage IGEN uses the same bias voltage stage as amplifier OTA. Curvature compensation stage IGEN includes current source CS2 which generates a bias current IB also used by amplifier OTA. Bias current IB has a positive temperature coefficient because it increases with increasing temperature. This is indicated by PTAT in brackets in FIG. 3. Curvature compensation stage IGEN further includes two transistors P5 and P5C. Transistor P5C is a cascode transistor. The gate voltage VCP of transistor P5C is the same that is used for transistors P3C and P4C in the output stage of amplifier OTA. The channels of transistors P5 and P5C are coupled in series. The gate of transistor P5 is coupled to the node between the channel of transistor P5C and current source CS2. Transistors P5 and P5C are PMOS transistors in this embodiment. Resistor R33 is coupled between transistor P5 and power supply VDD. Bias current IB is drawn from VDD through the channels of transistors P5 and P5C and resistor R33. The gate of transistor P5 is coupled to the gates of transistors P3 and P4 of the output stage of amplifier OTA and also to the gate of transistor P6. Transistor P6 has its channel coupled between power supply VDD and transistor P6C. The gate of transistor P6C is coupled to the gate of transistor P5C. Transistor P6C also receives the constant cascode voltage level VCP. Transistors P3, P4, P5 and P6 have the same voltage level VGP at their gates. Cascode transistors P3C, P4C, P5C and P6C also receive the same voltage level VCP at their gates. Resistors R31, R32 and R33 are all of the same type. Resistors R31, R32 and R33 may also be matched. The branch including transistors P6 and P6C has no resistor. The drain/source of transistor P6 is directly coupled to power supply VDD. This forms a current mirror including mismatched transistors P5 and P6. Transistor P6C is coupled to transistor N3. Transistor N3 is coupled in current mirror configuration to transistor N4. The gate of transistor N3 is coupled to the channel terminal of transistor N3 which receives the current from transistor P6C. The other channel terminal of N3 is coupled to resistor R36 whose other terminal is coupled to ground. Transistors N3 and N4 are NMOS transistors in this embodiment. Current IBX is fed from transistor P6C of the current mirror including transistors P5, P6, P5C and P6C and the resistor R33 to transistor N3 of the current mirror including transistors N3 and N4 and resistor R36. This circuit operates in a translinear current mode circuit. This circuit exploits two times the well known quadratic relationship between the drain current and the gate-source voltage of a MOSFET in strong inversion.

Resistor R33 and resistor R36 provide the specific mismatch of the two current mirrors to implement the translinear transfer function. The specific temperature characteristic of the non-linear behavior of IPTATN may be adjusted by adjusting the values of resistors R36 and/or R33. Bias current IB is transformed into a non-linear current IPTATN at the output of the current mirror including transistors N3 and N4 at the drain of transistor N4. This current IPTATN is drawn from the common resistor node CRN shown in FIG. 2 to provide the required VBE curvature compensation.

Due to the square relationship between the gate source voltage and the drain source current of a MOSFET, current IPTATN can be a function of IB to the fourth power. Resistors R33 and R36 provide that the current mirrors P5, P6 and N3, N4 are unbalanced and that the gate source voltage of P6 and N4 is a function of the drain currents through P5 and N3 due to the respective voltage drops across R33 and R36. Thus current IPTATN is approximately two times squared current IB. If the current IB also depends on the temperature, even more sophisticated transfer functions may be implemented.

This invention exploits the square relationship between the drain current and the gate source voltage of a MOSFET. This provides the translinear behavior of curvature compensation stage IGEN. In this context translinear refers to the non-linear transfer characteristic of curvature compensation stage IGEN. The input signal to curvature compensation stage IGEN is current IB. Therefore, curvature compensation stage IGEN may be called a current mode stage. The other stages of the bandgap reference generator are implemented in voltage mode. This means that the bangap reference generator according to FIGS. 2 and 3 is a combination of voltage mode and current mode stages.

Although the invention has been described hereinabove with reference to a specific embodiment, it is not limited to this embodiment and no doubt further alternatives will occur to the skilled person that lie within the scope of the invention as claimed.

What is claimed is:

1. A method of generating a reference voltage comprising the steps of:

generating a controlled current with a feedback loop comparing voltage drops in a first path including a first bipolar transistor and a second path parallel to the first path including a second bipolar transistor;

generating a non-linear compensation current for compensating a temperature dependent variation of a voltage drop across said first and second paths;

supplying the controlled current to a common node of the first path and the second path; and drawing the compensation current from the common node thereby generating a voltage drop across a resistor carrying the controlled current with a positive temperature coefficient.

2. The method of claim 1, wherein:

said step of generating a controlled current includes constructing said first bipolar transistor having an emitter area which is N times an emitter area of said second bipolar transistor.

3. The method of claim 1, wherein:

said step of generating a non-linear compensation current includes forming a translinear current mode circuit.

4. The method of claim 1, wherein:

said step of generating a controlled current includes constructing an amplifier comprising only resistors of a first type; and said step of generating a non-linear compensation current includes forming a translinear current mode circuit comprising only resistors of said first type.

5. The method of claim 1, wherein:

said step of generating a non-linear compensation current includes forming a mismatched current mirror.

* * * * *